US007805970B2

(12) United States Patent
Woulds

(10) Patent No.: US 7,805,970 B2
(45) Date of Patent: Oct. 5, 2010

(54) CAN MANUFACTURE

(75) Inventor: William Woulds, Shipley (GB)

(73) Assignee: Crown Packaging Technology, Inc., Alsip, IL (US)

( * ) Notice: Subject to any disclaimer, the term of this patent is extended or adjusted under 35 U.S.C. 154(b) by 475 days.

(21) Appl. No.: 10/574,260

(22) PCT Filed: Oct. 8, 2004

(86) PCT No.: PCT/EP2004/011308

§ 371 (c)(1),
(2), (4) Date: Mar. 28, 2006

(87) PCT Pub. No.: WO2005/039798

PCT Pub. Date: May 6, 2005

(65) Prior Publication Data

US 2008/0229801 A1 Sep. 25, 2008

(30) Foreign Application Priority Data

Oct. 15, 2003 (EP) ..... 03256515

(51) Int. Cl.
*B21D 22/00* (2006.01)

(52) U.S. Cl. ..... 72/349; 72/342.3

(58) Field of Classification Search ..... 72/41, 72/43, 44, 45, 347, 348, 349, 342.2, 342.3, 72/715, 342.7, 379.4
See application file for complete search history.

(56) References Cited

U.S. PATENT DOCUMENTS

| | | | | | |
|---|---|---|---|---|---|
| 3,577,753 | A * | 5/1971 | Shah et al. | ..... | 72/41 |
| 4,148,208 | A * | 4/1979 | Maeder | ..... | 72/342.4 |
| 4,223,544 | A * | 9/1980 | Main | ..... | 72/45 |
| 4,502,313 | A * | 3/1985 | Phalin et al. | ..... | 72/342.3 |
| 4,554,815 | A * | 11/1985 | Weishalla | ..... | 72/349 |
| 4,852,377 | A * | 8/1989 | Mikas et al. | ..... | 72/349 |
| 5,632,171 | A * | 5/1997 | Kunka et al. | ..... | 72/43 |
| 5,678,439 | A * | 10/1997 | Dunwoody et al. | ..... | 72/45 |
| 5,692,409 | A * | 12/1997 | Cheers et al. | ..... | 72/349 |
| 6,598,450 | B2 * | 7/2003 | Blue | ..... | 72/342.3 |
| 6,598,451 | B2 * | 7/2003 | Blue | ..... | 72/342.3 |
| 6,776,021 | B2 * | 8/2004 | Scholey | ..... | 72/349 |
| 7,107,811 | B2 * | 9/2006 | Zauhar | ..... | 72/349 |

FOREIGN PATENT DOCUMENTS

WO WO 03/039780 A1 5/2003

* cited by examiner

*Primary Examiner*—Edward Tolan
(74) *Attorney, Agent, or Firm*—Miles & Stockbridge P.C.; David R. Schaffer, Esq.

(57) ABSTRACT

An assembly for can manufacture includes a toolpack having coolant dies (3,4,5,6) adjacent and either side of ironing dies (1,2) so that coolant may be circulated around cavities in the coolant dies so as to cool the ironing die inserts (12). Generally, the toolpack is used in conjunction with a ram (20), coolant tube assembly (30) and ram guidance assembly (60) which together ensure that the ram is cooled along its entire length, up to and including the punch nose (21).

20 Claims, 7 Drawing Sheets

CAN MANUFACTURE

This invention relates to can manufacture and, in particular, to the production of thin-walled metal cans by the so-called "drawing and wall-ironing" (DWI) process.

In a DWI process, a flat circular blank of metal is drawn through one or more drawing dies to form a shallow cup. The cup is then mounted on the free end of a punch which extends from a reciprocating ram, and the cup wall is then "ironed" by passing through one or more ironing dies to lengthen the side wall of the cup and form a can.

The ironing process produces elongation of the side wall by very high radial compression of the wall of the cup as the cup is pushed through the ironing dies and is ironed by die inserts (sometimes referred to as the die "nibs").

Friction resulting from the ironing process generates heat in the punch and ironing dies. Furthermore, misalignment of the punch with the die assembly or "toolpack" may result in uneven distribution of temperature around the punch and die inserts. One technique which has been used to accommodate deflection of the punch from its central position is to use so-called "floating" dies which are supported by rubber O-rings or coil springs in the dies which impart resilience to the dies and allow these to move radially with respect to the axis of the punch.

One proposal to reduce the temperature of the die insert is disclosed in WO 03/039780 (Sequa Machinery, Inc.) in which a toolpack includes ironing dies which have conduits for channelling cooling fluid between an outer surface of the die insert and the die case. This toolpack differs from many conventional toolpacks in that the coolant fluid is not applied to the exterior of the toolpack where the cooling fluid may risk contamination of the container surface, necessitating cleaning of the cans after forming. This is a particular problem if the can material has a coating which could be attacked or damaged by coolant.

Nonetheless, although no extra washing is required with the Sequa system, it does exhibit a number of other drawbacks. Firstly, although the Sequa toolpack is a floating system, the dies are fixed together and cannot be removed radially to allow for individual maintenance of die modules. Secondly, there are several O-rings used in each die of this system which act as seals and care is needed to replace these correctly without poor seating. Finally, the die inserts ("nibs" in the Sequa disclosure) are subjected to large forces during the ironing operation but because the coolant is channelled close to the surface of the carbide die insert, this renders the inserts too fragile for high speed production of DWI cans.

According to the present invention, there is provided an apparatus for the production of a metal container, the apparatus comprising: at least one die having an insert adapted to reduce the thickness of the container side wall by ironing; at least one coolant die adjacent the ironing die(s) and having an internal cooling cavity for circulating coolant within the coolant die and adjacent the ironing insert of the ironing die.

By using a coolant die rather than introducing channels into the ironing die itself, coolant is directed close to the ironing insert, as in known systems, but without weakening the die insert. The ironing die insert may also be reduced in width since the cooling action is achieved using an independent cooling die or dies. The die insert is typically of carbide since the thermal conductivity of carbide is approximately twice that of the steel from which the rest of the ironing die is made. This carbide insert may be extended, i.e. made larger in diameter, in the present apparatus so as to increase the contact area with the adjacent cooling cavity, and thereby extract heat faster. Any number of coolant dies may be used, depending on the desired progression length and range of heights of cans for manufacture.

Usually the cooling cavity has an inlet and an outlet, the outlet including a restrictor. Using a restrictor at the outlet creates back pressure to ensure that the cooling cavity stays full of coolant, thereby presenting the maximum possible cooling surface to the adjacent die insert and avoiding dry spots which would allow heat build up.

The coolant die may include a vacuum port for removal of debris. The coolant die at the exit of the apparatus (i.e. where the punch exits the toolpack) may include an array of air jets arranged around its inner surface to prevent any debris from settling on the surface of the can.

Preferably the cooling cavity includes a portion which is inclined towards the adjacent die insert to form a cooling face. Generally a coolant die is provided on each side of an ironing die so that the die insert of the ironing die has heat extracted from both sides by adjacent coolant dies. By angling the cooling cavities towards the ironing die inserts, the working portion of the coolant cavities (lands) are as close as possible to the centre of the die insert.

In a preferred embodiment, the apparatus further comprises a system for biasing the cooling face against the ironing die. For example, the cooling face may be formed from an annular piston which is resiliently mounted on the body of the coolant die, the biasing system for activating the piston being provided by cooling fluid pressure. This cooling fluid pressure may be provided by the back pressure deriving from use of a restrictor at the outlet to the cooling cavity.

Floating dies have to have axial clearance in order to move ("float") and consequently they can vibrate. An additional benefit of the biasing system is that it acts as a damper to reduce ring vibration which can cause radial ring marks on the surface of a can in a floating toolpack. The piston keeps the cooling face in full contact with the die at all times whilst still allowing the die to float. This clamping could alternatively be achieved by coil springs, disc springs, O-rings, rubber springs, polyurethane etc.

Generally, the apparatus also comprises a ram having a cooling tube assembly at one end and a punch at the other end, the punch being connected to the ram by a ram spigot, a cooling fluid inlet formed partly between inner and outer concentric tubes of the cooling tube assembly and partly between an axial extension of the inner tube of the cooling tube and the inside of the ram spigot, a cavity adjacent the punch nose which is connected to the cooling fluid inlet by one or more holes, the cavity being further connected to a cooling fluid outlet by one or more holes, the cooling fluid outlet being formed (a) between the punch and the outside of the ram spigot, (b) by one or more holes in the body of the ram and (c) between the outer tube of the cooling tube assembly and the inside of the ram.

The apparatus may also include a tubular assembly for guiding the ram along its bore, the assembly having a fluid inlet, a fluid outlet and grooves around the surface of the bore for passage of cooling fluid around the outside of the ram. This guidance assembly thus also cools the punch/ram externally to help dissipate heat from the punch. This also maintains the ram at an even temperature and prevents ram distortion from uneven heat build up.

The ram guidance assembly may employ a seal arrangement at both ends to prevent the cooling fluid from leaking into the machine at the rear and leaking into the tooling at the front.

Preferred embodiments of the invention will now be described, by way of example, with reference to the drawings, in which.

Figure 1:
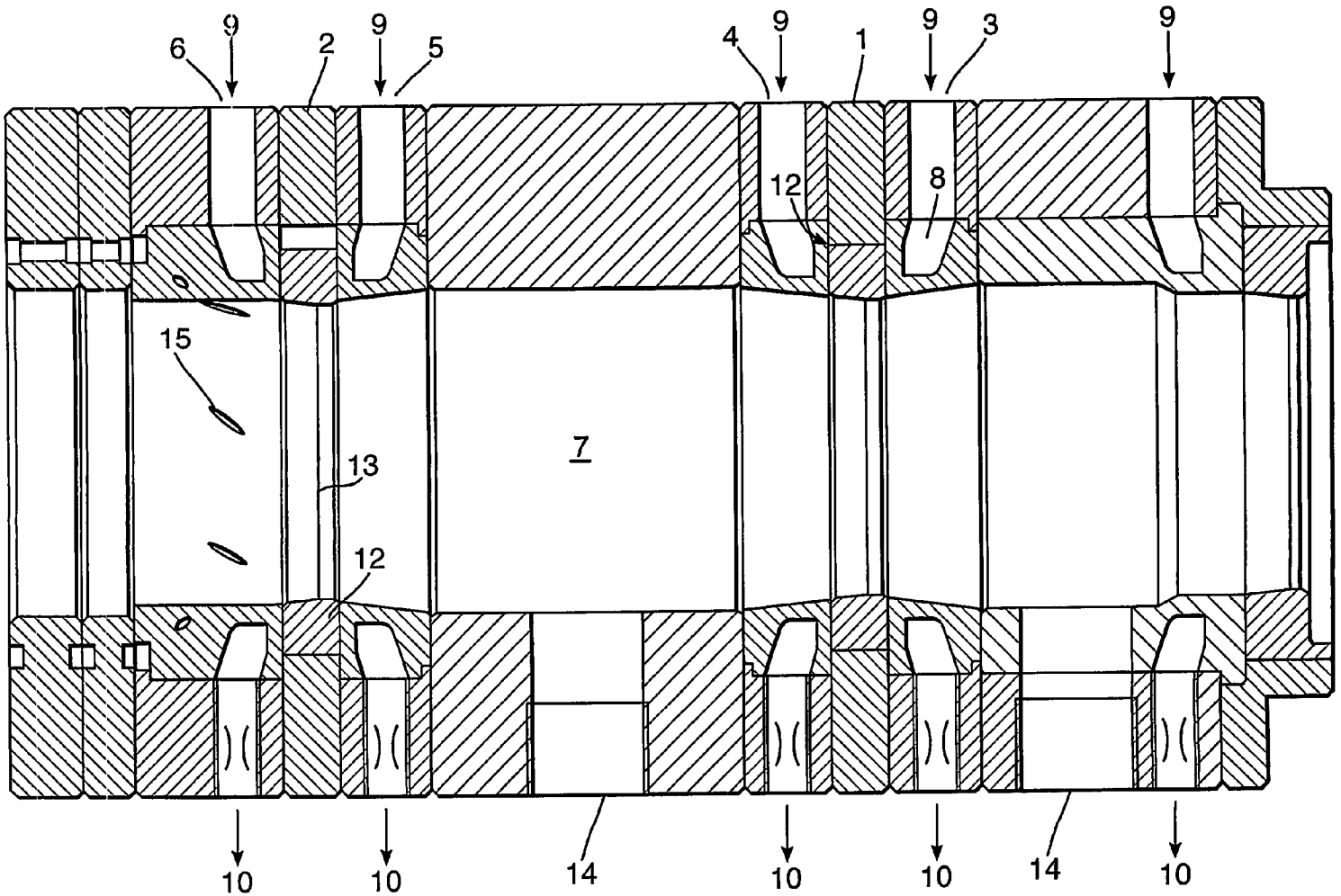
FIG. 1 is a side sectional view of a first embodiment of die toolpack.

FIG. 1 is a side section of the die toolpack assembly of the invention comprising a series of ironing dies 1, 2, and spacers 3,4 and 5,6 and surrounding a central bore 7. Friction due to the ironing process generates heat in the working portion of the ironing die. In contrast with known cooling systems, this heat is extracted from the ironing dies on both sides by the spacers rather than cooling via fragile inserts on the dies themselves. As a result of this, the ironing dies can be readily removed or changed without removal of screws or risk of coolant fluid spillage. Furthermore, the toolpack of the invention is cooled without allowing coolant into the bore of the machine through which the punch passes during ironing. This is particularly important if the material of which the can is made or of which it is coated might be attacked by such coolant.

Each spacer includes a coolant cavity 8 which is fed coolant from a single fixed inlet 9 on one side of the spacer. The cavity may be formed, for example, by grooves in inner and outer die spacers which form a channel when the parts are clamped together.

The water circulates round the spacer and exits on the opposite side 10 through a restrictor 11 to a common sump to be returned to the cooling unit. The use of restrictors at the outlet ports 10 creates a backpressure to ensure that the cooling cavity stays full and maintains an optimum cooling surface around the die. Furthermore, by regulating flow with flow restrictors on the exhaust side, flow can be tuned around each die independently. This means that dies can be cooled by different amounts and to different temperatures according to the work done by the die, such as degree of ironing. By exhausting coolant to a tank, no coolant contacts the can. This is particularly useful if the coating on the can could be attacked or damaged by coolant and otherwise require an acid/alkaline rinse.

Each ironing die 1,2 includes a carbide insert 12 with the working portion 13 close to the centre of the insert. This carbide insert is contacted by coolant spacers, typically of tooled steel, on both sides. The coolant channels in the spacers are each angled towards the carbide insert 12 of the ironing die so that the optimum cooling surface area is provided.

A vacuum system 14 pulls away dust or debris from the can surface. If such debris were allowed to build up internally, it would cause surface scratching in the ironing process, particularly when the can has a coating such as a polymer coating. Air jets 15 or a knife system may be incorporated into any or all of the spacers, here shown in the end spacer 6, to prevent debris collecting around the end die. A further air jet/knife may be used to prevent debris collecting in the stripper area (not shown).

By using a fixed toolpack rather than floating, the use of seals is not required in the embodiment of FIG. 1. When such seals need to be changed due to damage or leakage, they must be replaced with care to avoid poor seating.

Figure 2:
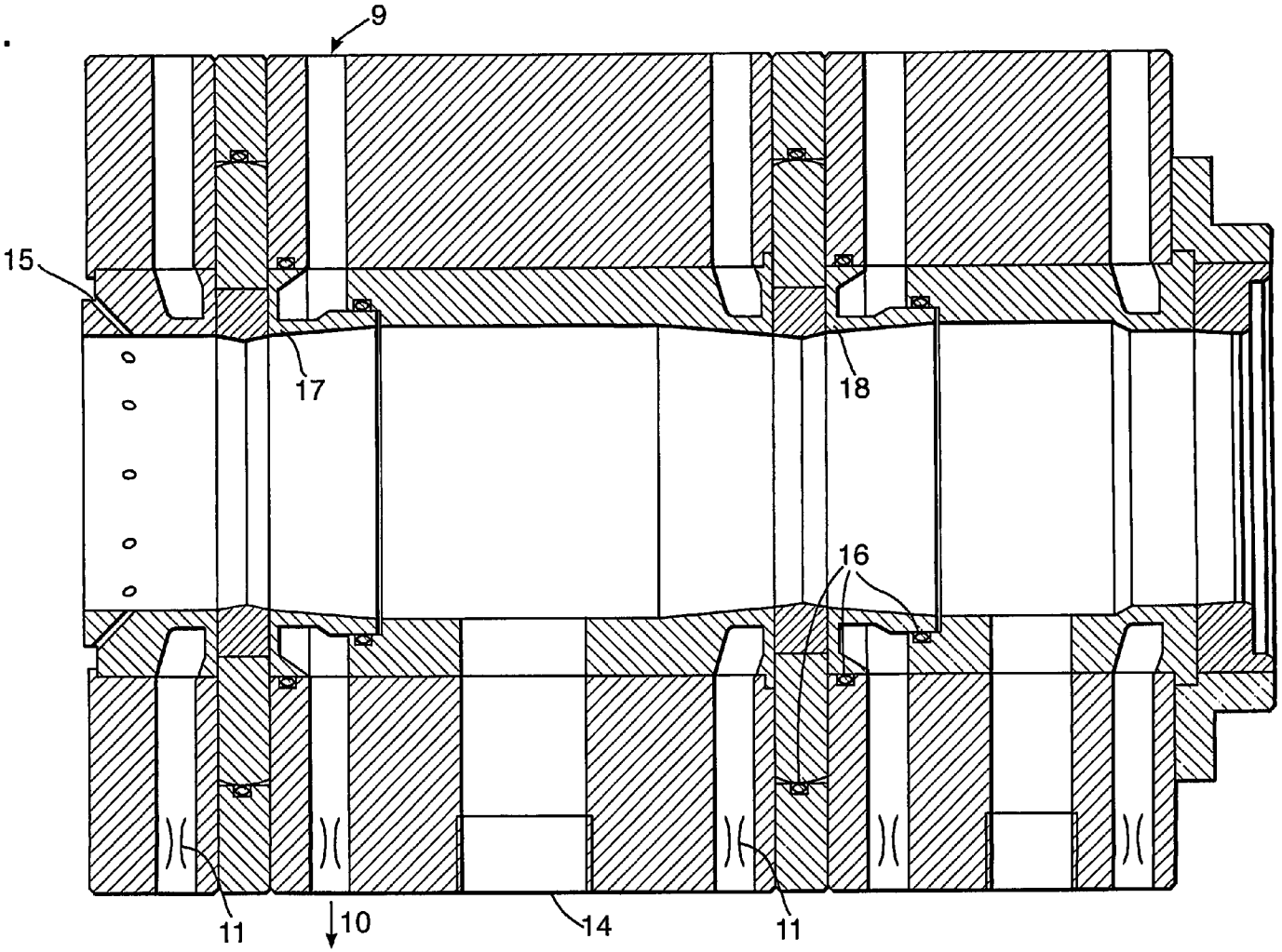
FIG. 2 is a side sectional view of a second embodiment of die toolpack.
Figure 3:
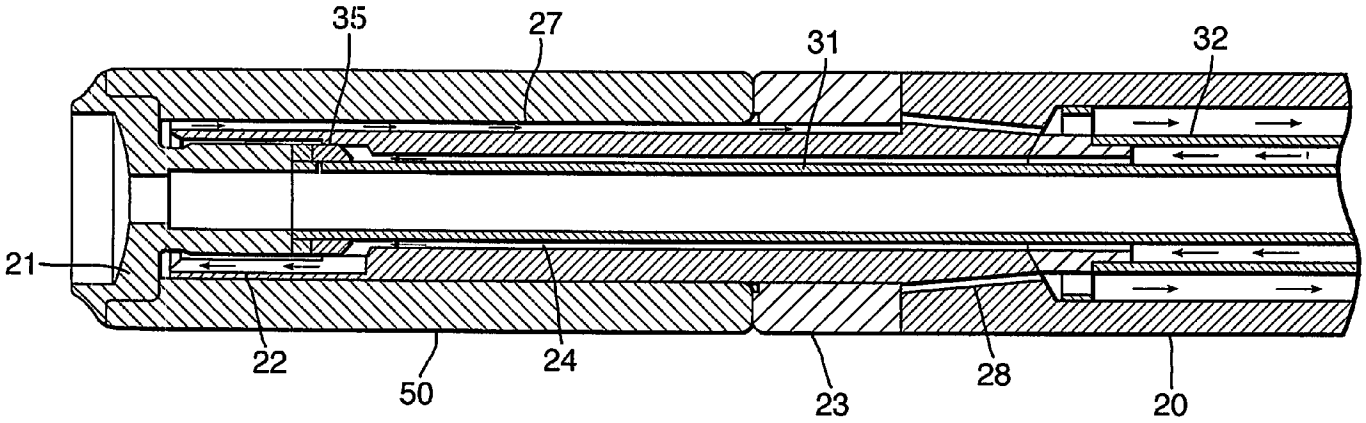
FIGS. 3 to 7 are side sectional views of a ram coolant system.
Figure 4:
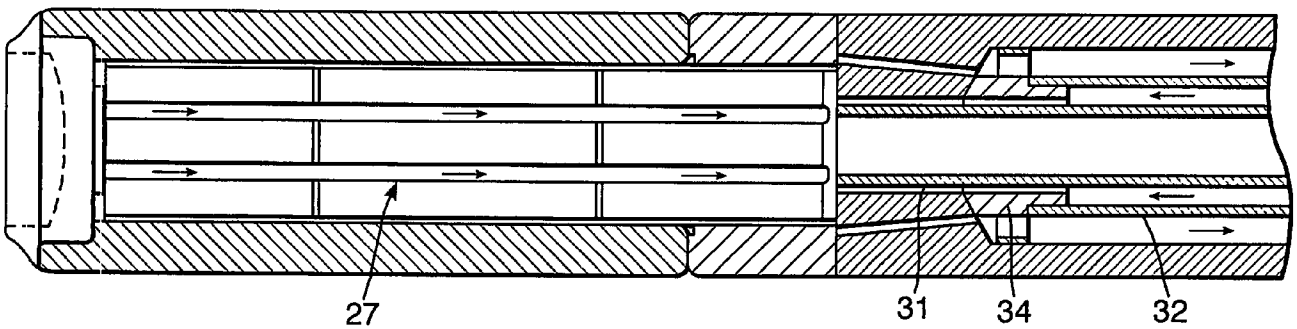

An alternative die toolpack assembly according to the invention is shown in FIG. 2. The toolpack of FIG. 2 is a floating toolpack system which uses O-rings 16 to allow compliance. In this toolpack, back pressure created by the restrictors 11 is used to operate a cylinder 17 which ensures that the cooling surface 18 stays in contact with the dies. The cylinder 17, which is in the rear face of the spacer, forms a piston. Floating dies inherently have to have axial clearance in order to move which can lead to vibration and result in ring marks around the can. The piston doubles as a damper to reduce the vibration which causes these ring marks. Such die vibration is common in floating systems.

The piston is activated by the cooling fluid pressure which keeps the cooling face in contact with the die at all times whilst still allowing the die to float. This clamping could also be applied by a spring system, which could be coil springs, disc spring, 'O' ring, rubber spring, polyurethane etc.

When a can is wall ironed, it is carried by a punch in which heat is also generated due to the friction involved in the process. Cooling of the punch/ram is therefore also of great importance, particularly if the can has a coating which can be damaged by heat, such as a plastic coating or tin coated steel. A ram coolant system for use with the die toolpack of FIG. 1 is shown in FIGS. 3 to 9. In the system of the present invention, the whole ram assembly is cooled along its length, down to and including the punch nose 21. The cooling fluid is in contact with the back of the punch nose 21, the internal diameter of the punch and any spacers 23.

Figure 8:
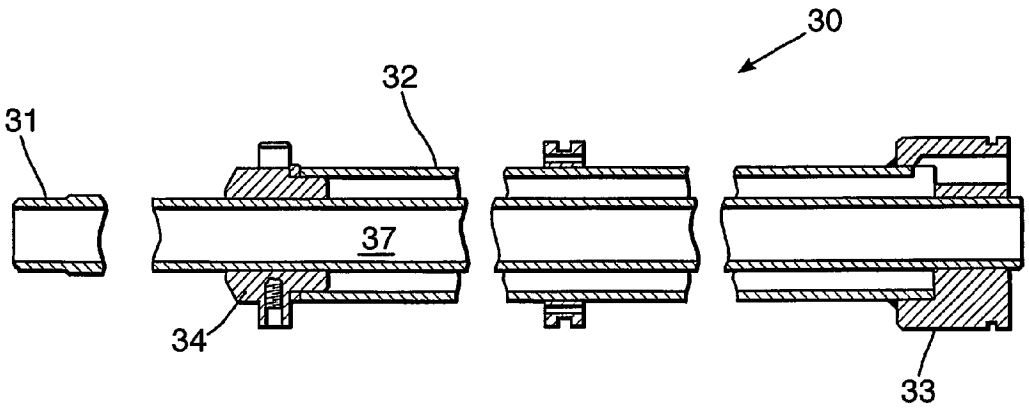
FIG. 8 is a side sectional view of a coolant tube assembly.
Figure 9:
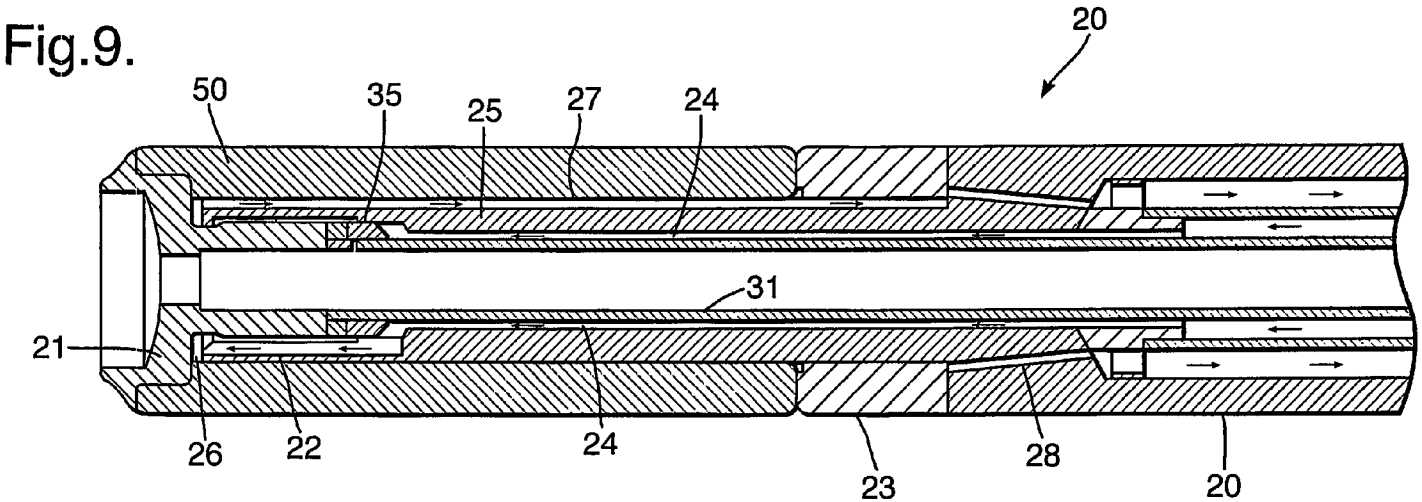
FIG. 9 is an enlarged side sectional view of the ram of FIG. 3.

With particular reference to FIGS. 8 and 9, the ram is fitted with a coolant tube assembly 30. The coolant tube assembly 30 comprises inner and outer concentric tubes 31, 32 which are fastened together at connection points 33, 34. Galleries at the connection points allow for the flow of coolant such as cooling water, and air.

Figure 6:
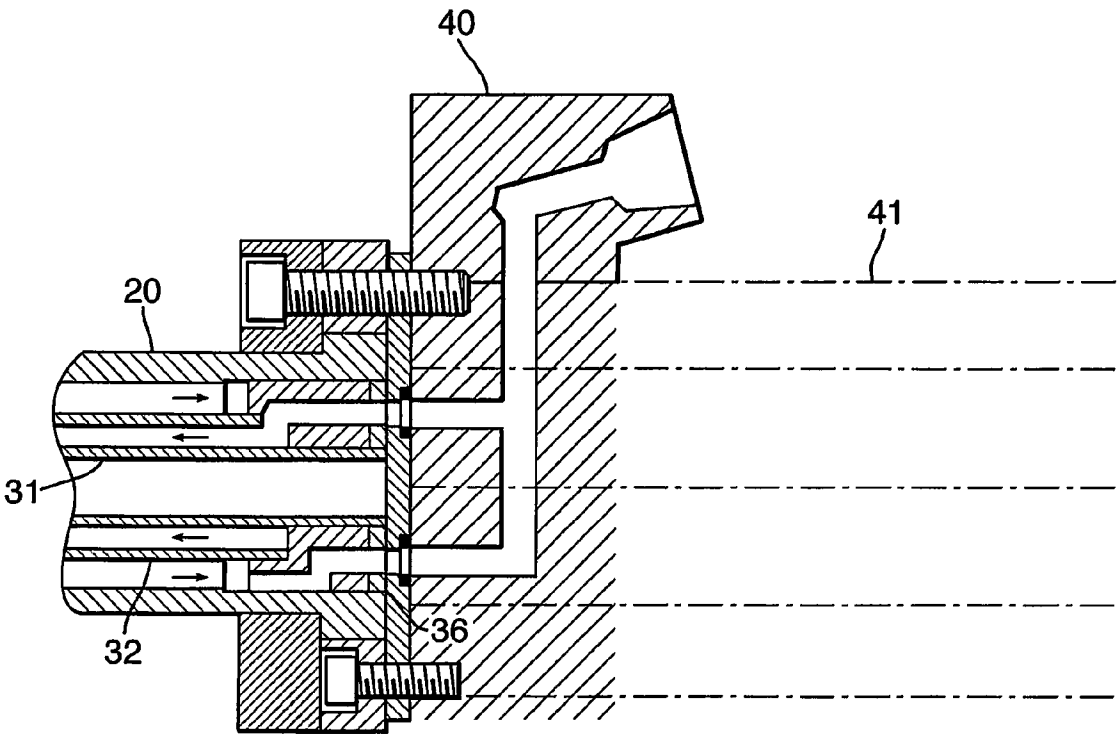
Figure 5:
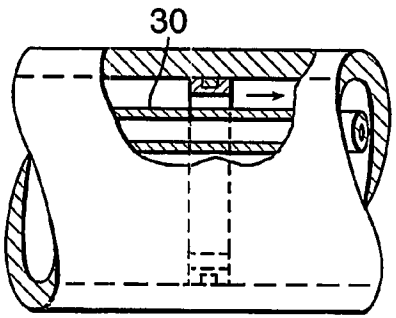
Figure 7:
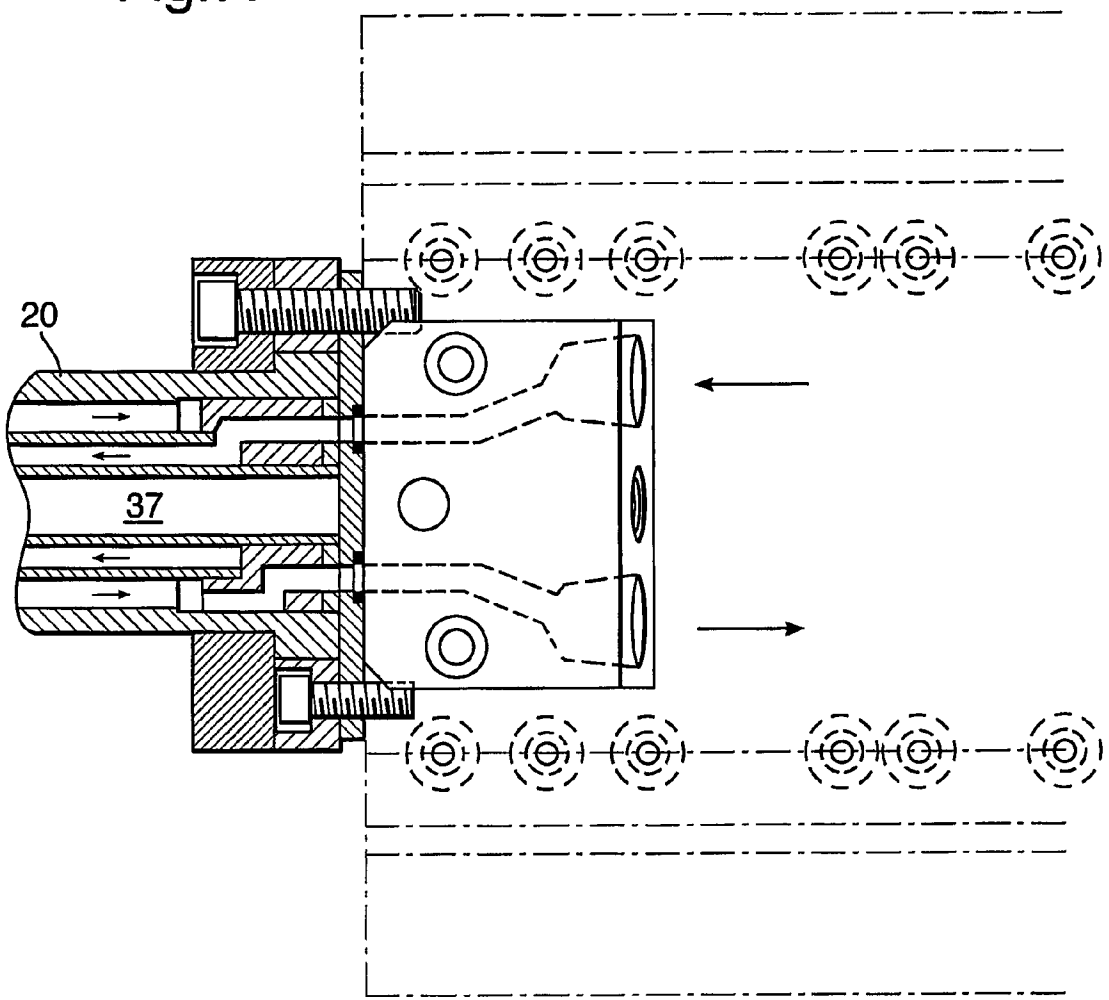

With reference to FIGS. 6 and 7, the ram 20 is connected to a yoke slide 41, a seal 36 on that end of the coolant tube assembly 30 sealing air, incoming water and outgoing water supplies. Air passes down the centre tube 37 to assist stripping of the can from the punch 50. A seal assembly on the connection point 35 at the punch end of the cooling water tube assembly separates the cooling water and air strip. Alternatively a seal could be incorporated into the punch nose.

Cooling water is fed in through a manifold 40 mounted on the yoke slide 41, not directly to the ram (see FIG. 7). The coolant passes down the cooling water tube assembly 30, between the inner and outer tubes 31, 32. From there, coolant flows into the tubular cavity 24, between the inner tube 31 and the inside of a ram spigot 25. As shown in FIG. 9, the coolant then flows past the punch retainer through holes 22 and into cavity 26.

Coolant then returns back between the outside of the ram spigot 25 and the inside of the punch 50 along slots 27. It passes back into the main body of the ram through holes 28 and travels back between the outer tube 32 of the cooling water tube assembly and the inside of the ram to the manifold 40 on the yoke slide 41.

It should be noted that the terms "holes, "cavities" and "grooves" used above are used with reference to the drawings and for the purposes of differentiation only rather than being intended as being limiting in any way.

By use of a single cooling water tube assembly and channels cut in the outside diameter of the ram spigot 25 on which the punch 50 is mounted, there is no requirement for a cavity on the inside of the punch to connect the inlet and outlet ports. Further cooling is aided by reducing the central portion or portions of the ram spigot to create a large chamber for the fluid to contact the inner surface of the punch. Integrity of the ram spigot is improved in the assembly of the present invention as radially drilled holes used in prior art systems are avoided. These create stress raisers and can cause premature failure of the ram if a crack in the ram surface runs radially from one hole to the next.

Figure 10:
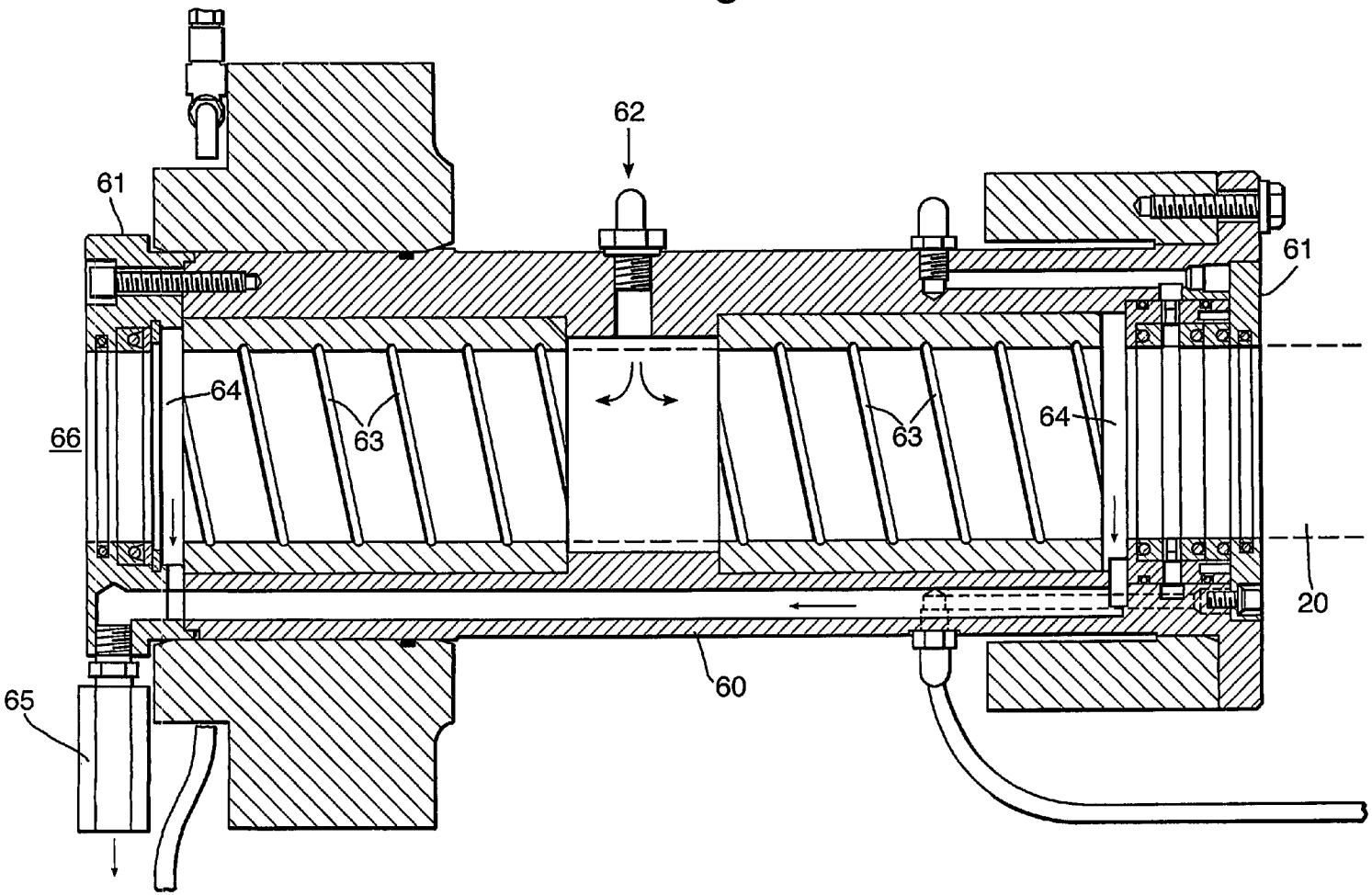
FIG. 10 is a side sectional view of ram guidance assembly.

As well as cooling the punch/ram internally, the ram is also cooled externally by the ram guidance assembly 60 of FIG. 10. This assembly helps to dissipate heat from the punch and maintain the ram at an even temperature. If uneven heat builds up on the ram, this can lead to distortion of the ram. The ram guidance assembly 60 prevents such temperature differences from arising.

The assembly 60 has a seal arrangement 61 at both ends to prevent cooling fluid from leaking into the machine at the rear and leaking into the tooling at the front. The fluid is fed in under pressure at the position 62 as indicated by the arrow. It then passes along two bushes and round spiral grooves 63 in both directions, lubricating and cooling the ram 20. The coolant exits into cavities 64 between bushes and the seal packs 61. It then exits the ram guidance assembly via slots and holes in the housing and out through a check valve 65 back to the machine collection sump where it is returned to a chiller unit. The check valve 65 ensures that the assembly stays full of fluid and that there is complete coverage of the ram.

When the ram is fully back, the end of the punch fitted to the ram is level with the end of the front seal pack at position 66 on the drawing.

Although a preferred embodiment of the invention has been specifically illustrated and described herein, it is to be understood that minor variations may be made in the apparatus without departing from the spirit and scope of the invention, as defined by the appended claims.

What is claimed is:

1. An apparatus for the production of a metal container comprising:

at least one ironing die (1,2) having an insert (12) adapted to reduce the thickness of a container side wall by ironing;

at least one coolant die (3,4,5,6) on each side of and adjacent to the at least one ironing die having inclined portions toward said at least one ironing die and having an internal cooling cavity (8) for circulating coolant only within the coolant die adjacent the ironing insert (12) of the ironing die (1,2), and without allowing coolant into a central bore of the at least one coolant die (3, 4, 5, 6).

2. The apparatus according to claim 1 in which the cooling cavity has an inlet (9) and an outlet (10), and the outlet includes a restrictor (11).

3. The apparatus according to claim 1 in which the coolant die (3,4,5,6) includes a vacuum port (14) for removal of debris.

4. The apparatus according to claim 1 in which an exit coolant die (6) includes an array of air jets (15) arranged around an inner surface of the exit coolant die to prevent debris from settling on a surface of the container side wall.

5. The apparatus according to claim 1 in which the cooling cavity (8) includes a portion which is inclined towards the adjacent die insert (12) to form a cooling face (18).

6. The apparatus according to claim 5 including means for biasing the cooling face (18) against the ironing die.

7. The apparatus according to claim 6 in which the cooling face (18) is a substantially annular piston (17) which is resiliently mounted on the coolant die, and the biasing means is operative for activating the annular piston by utilizing cooling fluid pressure.

8. The apparatus according to claim 1 including a ram (20) having a cooling tube assembly (30) at one end and a punch (50) at an opposite end, and the punch being is connected to the ram by a ram spigot (25).

9. The apparatus according to claim 8 in which a cooling fluid inlet is formed partly between inner and outer concentric tubes (31,32) of the cooling tube assembly (30) and partly between an axial extension of the inner tube (31) of the cooling tube and inside of the ram spigot (25).

10. The apparatus according to claim 9 including a cavity (26) adjacent a punch nose (21) of the punch (50) which is connected to the cooling fluid inlet by at least one hole (22), the cavity (26) being connected to a cooling fluid outlet by at least one hole (28); and the cooling fluid outlet being formed (a) between the punch and the outside of the ram spigot, (b) by at least one hole in the body of the ram and (c) between the outer tube (32) of the cooling tube assembly (30) and the inside of the ram (20).

11. The apparatus according to claim 1 including a tubular assembly (60) for guiding a ram (20) along its bore, and the assembly having a fluid inlet (62), a fluid outlet and grooves (63) around the surface of the central bore for passage of cooling fluid around the outside of the ram (20).

12. The apparatus according to claim 2 in which the coolant die (3,4,5,6) includes a vacuum port (14) for removal of debris.

13. The apparatus according to claim 1 wherein said internal cooling cavity (8) includes a radially innermost annular channel defined at least in part by an innermost imperforate annular wall defining said central bore.

14. The apparatus according to claim 13 wherein said radially innermost annular channel is angled towards the adjacent die insert (12) to form a cooling face (18).

15. The apparatus according to claim 2 wherein said internal cooling cavity (8) includes a radially innermost annular channel defined at least in part by an innermost imperforate annular wall defining said central bore.

16. The apparatus according to claim 15 wherein said radially innermost annular channel is angled towards the adjacent die insert (12) to form a cooling face (18).

17. The apparatus according to claim 3 wherein said internal cooling cavity (8) includes a radially innermost annular channel defined at least in part by an innermost imperforate annular wall defining said central bore.

18. The apparatus according to claim 17 wherein said radially innermost annular channel is angled towards the adjacent die insert (12) to form a cooling face (18).

19. The apparatus according to claim 4 wherein said internal cooling cavity (8) includes a radially innermost annular channel defined at least in part by an innermost imperforate annular wall defining said central bore.

20. The apparatus according to claim 19 wherein said radially innermost annular channel is angled towards the adjacent die insert (12) to form a cooling face (18).

* * * * *